US006283298B1

(12) United States Patent
Seidler

(10) Patent No.: US 6,283,298 B1
(45) Date of Patent: Sep. 4, 2001

(54) AIRTIGHT CONTAINER AND METHOD FOR FILLING CONTAINER WITH PRODUCT

(75) Inventor: Stewart Seidler, Forest Hills, NY (US)

(73) Assignee: Concept Workshop Worldwide, LLC, New York, NY (US)

( * ) Notice: Subject to any disclaimer, the term of this patent is extended or adjusted under 35 U.S.C. 154(b) by 0 days.

(21) Appl. No.: 09/449,606

(22) Filed: Nov. 23, 1999

Related U.S. Application Data

(60) Provisional application No. 60/109,964, filed on Nov. 25, 1998, and provisional application No. 60/109,972, filed on Nov. 25, 1998.

(51) Int. Cl.[7] ..... B65D 85/00

(52) U.S. Cl. ..... 206/581; 53/471; 220/838; 220/839

(58) Field of Search ..... 132/293–305, 132/320; 53/471; 206/235, 581, 823; 220/817–819, 838, 840, 841, 839

(56) References Cited

U.S. PATENT DOCUMENTS

| | | | |
|---|---|---|---|
| 1,928,445 | 9/1933 | Boyd . | |
| 3,954,179 | 5/1976 | Warmath . | |
| 4,220,248 | 9/1980 | Wilson et al. . | |
| 4,289,232 | 9/1981 | Seibel et al. . | |
| 4,345,607 | 8/1982 | Contreras et al. . | |
| 4,421,127 * | 12/1983 | Geer | 132/294 |
| 4,454,889 | 6/1984 | Contreras, Sr . | |
| 4,545,495 | 10/1985 | Kinsley . | |
| 4,573,600 | 3/1986 | Dubach . | |
| 4,625,898 | 12/1986 | Hazard . | |
| 4,801,054 | 1/1989 | Nycz . | |
| 4,854,473 | 8/1989 | Dubach . | |
| 5,031,647 | 7/1991 | Seidler . | |
| 5,115,931 | 5/1992 | Dubach . | |
| 5,257,708 | 11/1993 | Dubach . | |
| 5,344,037 * | 9/1994 | Favre | 132/293 |
| 5,806,682 | 9/1998 | Mecca et al. . | |
| 5,842,486 | 12/1998 | Davis et al. . | |
| 5,875,795 | 3/1999 | Bouix . | |
| 5,896,866 | 4/1999 | Quennessen . | |
| 5,931,169 * | 8/1999 | Kervoalen | 132/294 |
| 5,950,639 | 9/1999 | Suzuki et al. . | |

* cited by examiner

*Primary Examiner*—Jim Foster
(74) *Attorney, Agent, or Firm*—Kramer Levin Naftalis & Frankel LLP

(57) ABSTRACT

A container adapted to seal the internal contents against exposure to the external environment when not is use includes a cover hingeably coupled to a base and a latch closure mechanism. At least one opening extends completely through the base. The interior surface of the cover is adapted to sealingly engage the opening in the base when the cover is pivoted against the base. A separate seal is provided to cover the opening at the bottom surface of the base to hold product within the opening between the interior surface of the cover and the seal.

21 Claims, 6 Drawing Sheets

FIG. 3
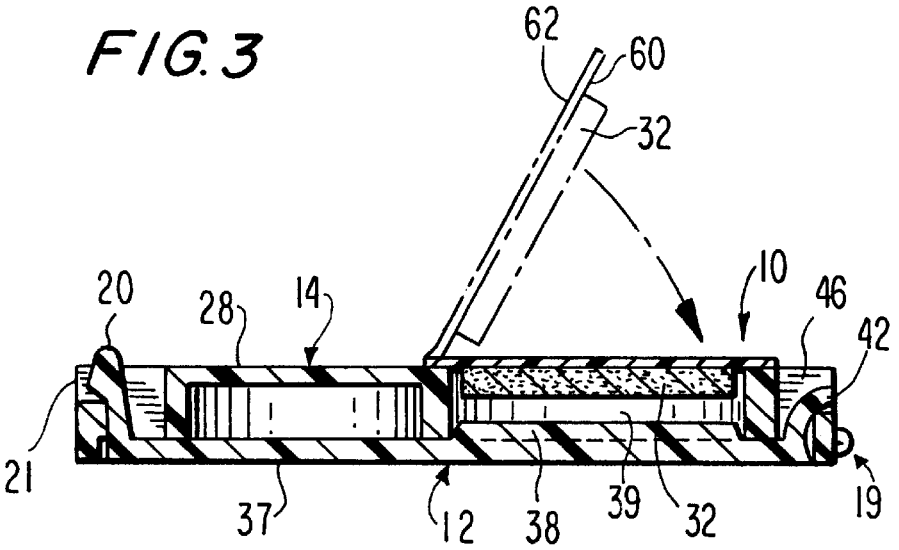
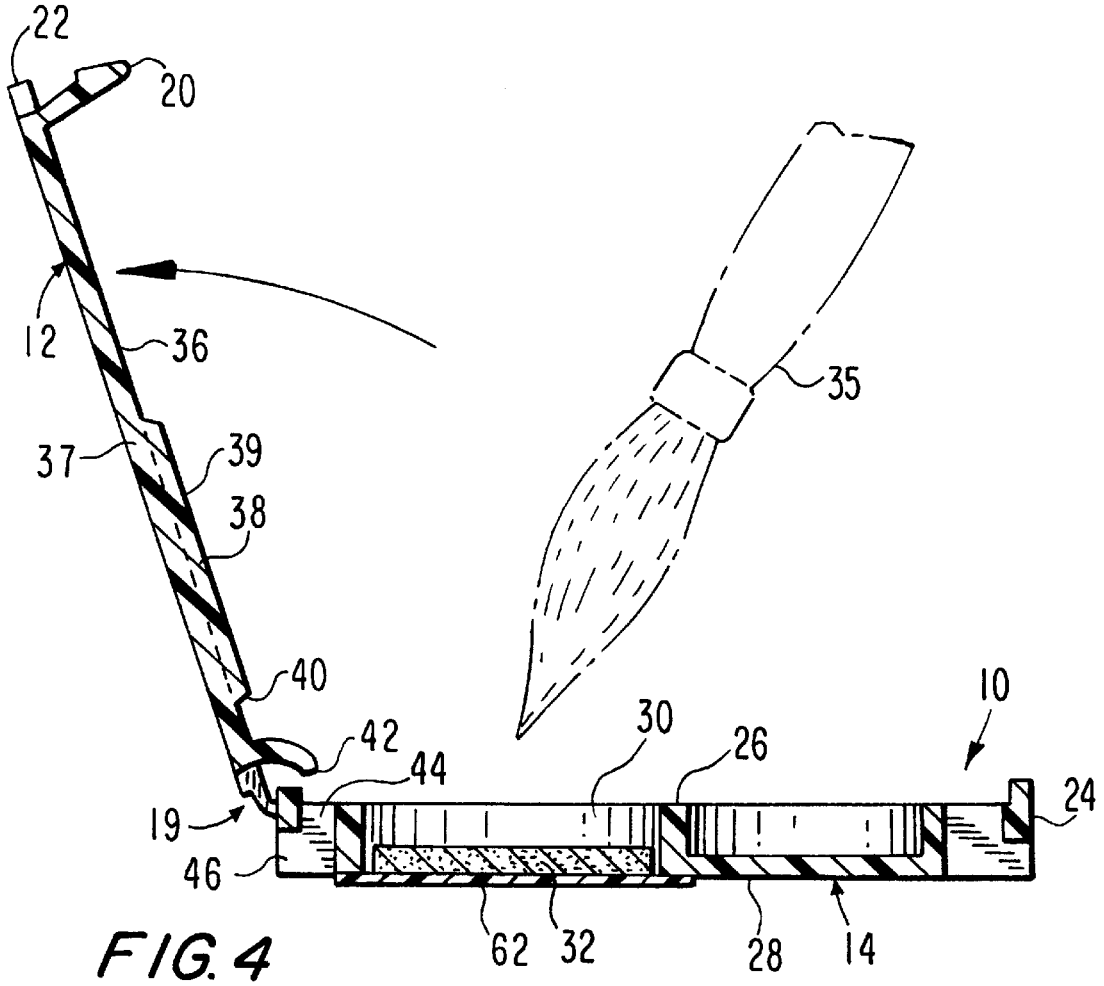
FIG. 4

AIRTIGHT CONTAINER AND METHOD FOR FILLING CONTAINER WITH PRODUCT

CROSS REFERENCE TO RELATED PROVISIONAL APPLICATIONS

This application claims the benefit of U.S. Provisional Patent Application Nos. 60/109,964 and 60/109,972 both filed on Nov. 25, 1998.

BACKGROUND OF THE INVENTION

The present invention relates generally to a container for holding a product. In particular, the present invention relates to a container adapted to seal the internal contents against exposure to the external environment when not in use, and to a novel method for efficiently filling the container with a sample of product.

Containers used to store products such as cosmetics are well known in the art. For example, a standard compact for holding a non-volatile cosmetic product typically includes a lid or a cover coupled to a base by a hinge. The cover can be pivoted about the hinge to expose the cosmetic product which is typically stored in a recessed compartment or well in the base. A latch is commonly provided to keep the cover in contact with the base when the cover is closed. While the latch is effective in keeping the cover of the container closed, it does not, in and of itself, provide an airtight seal to prevent dry cosmetic product from absorbing moisture from the air, or, conversely, to prevent the volatile chemical components of some cosmetics from evaporating.

Many containers available today provide airtight seals. Such airtight containers typically utilize screw caps, liners and gaskets, additional covers, and combinations thereof to seal the internal contents against exposure to the external environment when not in use. The present invention has been developed to improve over prior art airtight containers and to allow for efficient filling of the container with product.

SUMMARY OF THE INVENTION

Generally, in accordance with the present invention, an airtight container adapted to be filled with a sample of product, such as cosmetic product, is provided. The container includes a cover and a base each having interior and exterior surfaces and front and rear edges. The cover and base are pivotably coupled together at the rear edges thereof by a hinge. A latch mechanism or other common closure device is provided at the front edges of the cover and base to releasably secure the cover to the base when the container is closed.

When closed, the cover and base are compressively loaded by virtue of the construction of the hinge, the cover and base construction, and the latch. Compressive force results, in part, from the hinge height being less than the overall height of the container (i.e., the combined height of the cover and base). More particularly, when the cover is closed and latched, a compressive force is created as a result of the hinge being pulled to accommodate the height difference.

A preferred hinge mechanism includes one or more curved protrusions extending from the interior surface of the cover proximate to the rear edge of the cover that are adapted to engage corresponding slots extending through the base proximate to the rear edge of the base when the cover is articulated against the base to close the container. The protrusions extend into cavities or undercuts formed in the bottom of the base and lock against the rear edge of the base to pull the cover tightly against the base. Additionally, a living hinge may be provided between adjacent slots to pivotably connect the cover to the base.

An alternative hinge arrangement may take the form of a flexible planar connector joining the rear edge of the cover and the rear edge of the base. The flexible connector may extend along part or substantially all of the length of the rear edge of the container.

Also, the flexible connector between the rear edges of the cover and base may be provided with one or more hemispherical projections extending therefrom in registration with slots or undercuts defined in the exterior surface of the rear edge of the base. The protrusions engage the slots or undercuts when the cover is closed against the base and compress the cover against the base.

The base of the container according to the present invention includes an opening extending completely therethrough. A raised area or other suitable sealing member provided on the interior surface of the cover engages the opening in the interior surface of the base to form a seal with the opening when the cover is pivoted with respect to the base to close the container. The raised area extends only partially through the opening to allow space for the product to be introduced into the opening through the bottom of the base during filling of the container.

Filling of the container is accomplished by either (i) applying product to the surface of a separate seal such as a label or plastic sheet, and then affixing the seal over the opening in the base at the bottom of the base such that the product is introduced into the opening and is held in the space between the raised area and the seal, or, alternatively, by (ii) applying product through the opening in the base directly onto the surface of the raised area and then covering the opening with a separate seal such that the product is held in the space between the raised area and the seal.

Accordingly, it is an object of the present invention to provide an improved product sample container and method for filling the container with product.

Another object of the present invention is to provide a container capable of sealing the internal contents against exposure to the external environment in a substantially airtight manner when not in use.

A further object of the present invention is to provide a container that may be filled with a sample of product in an efficient manner.

Still other objects and advantages of the invention will in part be obvious and will in part be apparent from the following detailed specification.

The invention accordingly comprises the features of construction, combination of elements, and arrangement of component parts, as well as the several steps and the relation of one or more of such steps with respect to each of the others, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a sectional view of the container according to the present invention illustrating a preferred method of filling the container with product;

FIG. 4 is a sectional view of the container depicted in FIG. 3 in an open position as it is used;

DETAILED DESCRIPTION OF THE PREFERRED EMBODIMENTS

Figure 1:
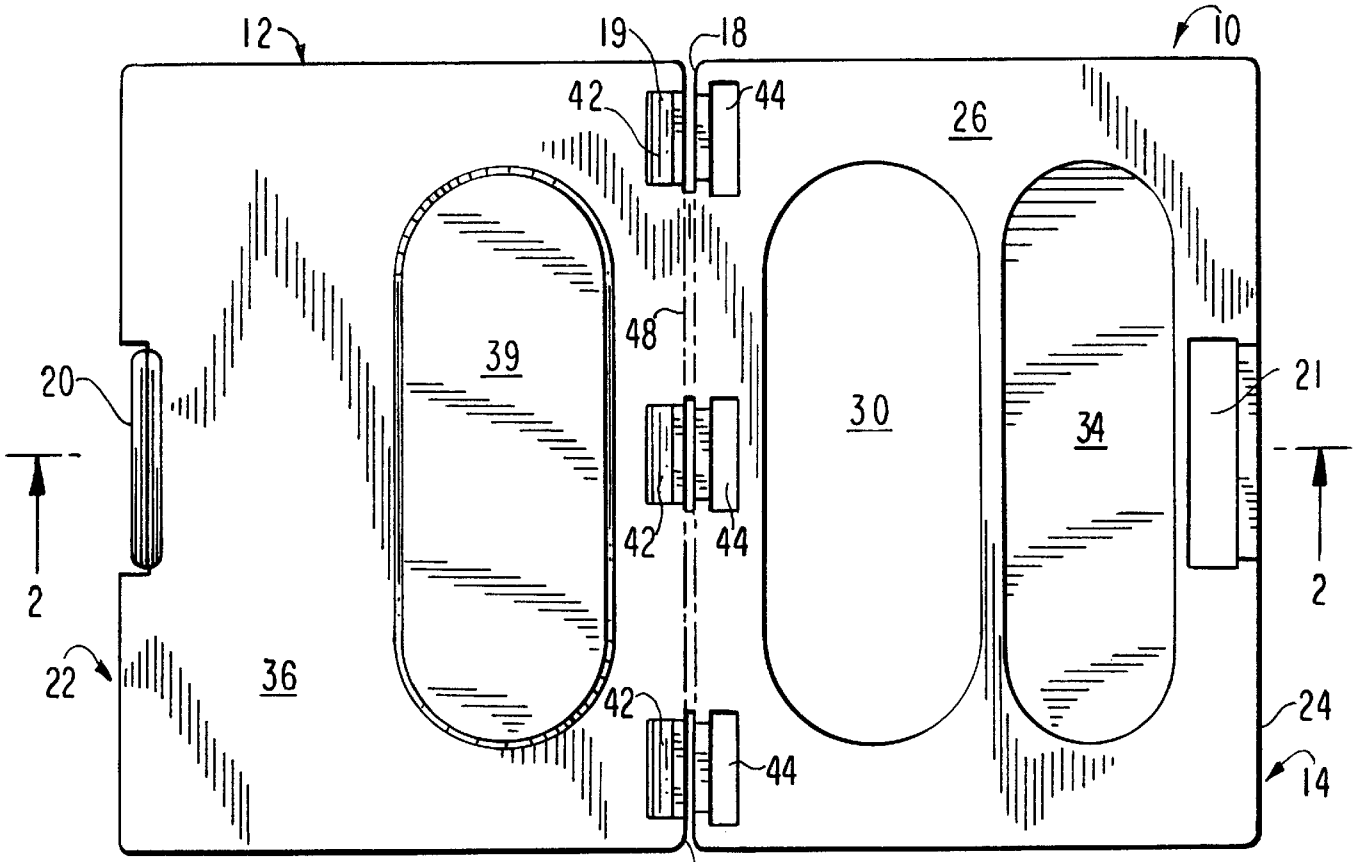
FIG. 1 is a top plan view of a cosmetic sampler container according to a preferred embodiment of the present invention shown in an open position.

In the drawings where like numerals indicate like elements, FIG. 1 shows a container according to the present invention which is generally designated by reference numeral 10. The container 10 is preferably formed or molded from a suitable plastic material or metal. Although container 10 shown in FIG. 1 has a preferred substantially rectangular shape, it should be understood that the container is not limited to this particular shape.

Figure 11:
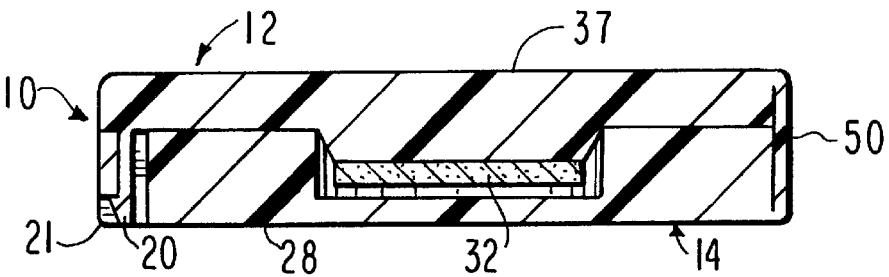
FIG. 11 is a sectional view of the alternative embodiment of the container depicted in FIG. 10 shown in a closed, sealed position.

Container 10 includes a cover 12 and a base 14. Cover 12 and base 14 are pivotably connected at their respective rear edges 16 and 18 by a hinge mechanism 19. The construction and arrangement of hinge mechanism 19, which will be described in greater detail hereafter, permits cover 12 to pivot between an open position, as shown in FIG. 1, for example, and a closed position, as shown in FIG. 11, for example.

Figure 2:
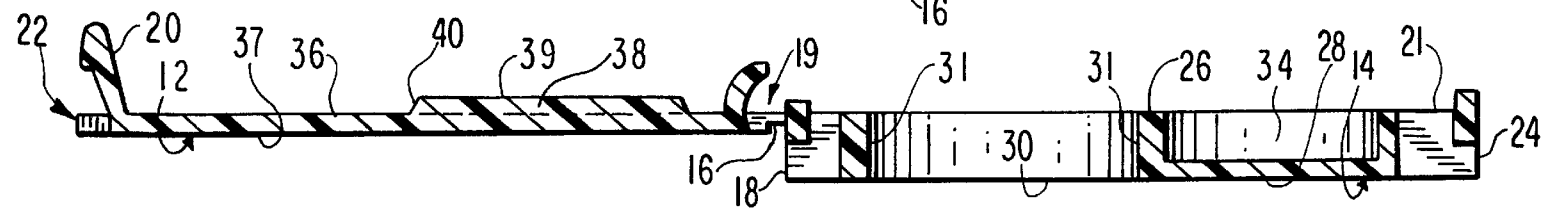
FIG. 2 is a sectional view of the cosmetic container depicted in FIG. 1 taken along lines 2—2 of FIG. 1.

Container 10 further includes a suitable closure mechanism for securing cover 12 in removable engagement with base 14 when the cover is in the closed position. As shown in FIG. 2, the closure mechanism is preferably a latch assembly including a latch member 20 and a mating engagement slot 21 provided at respective front ends 22 and 24 of cover 12 and base 14. It should be understood, however, that other suitable conventional closure mechanisms may be utilized to secure cover 12 to base 14, for example, a push-button assembly, a friction fit assembly, or a magnetic assembly.

As depicted in FIGS. 1 and 2, base 14 has an interior surface 26 and an exterior or bottom surface 28. An opening 30 is provided completely through base 14 and is defined by perimeter walls 31. Opening 30 is sized to accommodate a preselected amount of product, such as, for example, a cosmetic product 32, as will be described in greater detail hereafter.

Figure 6:
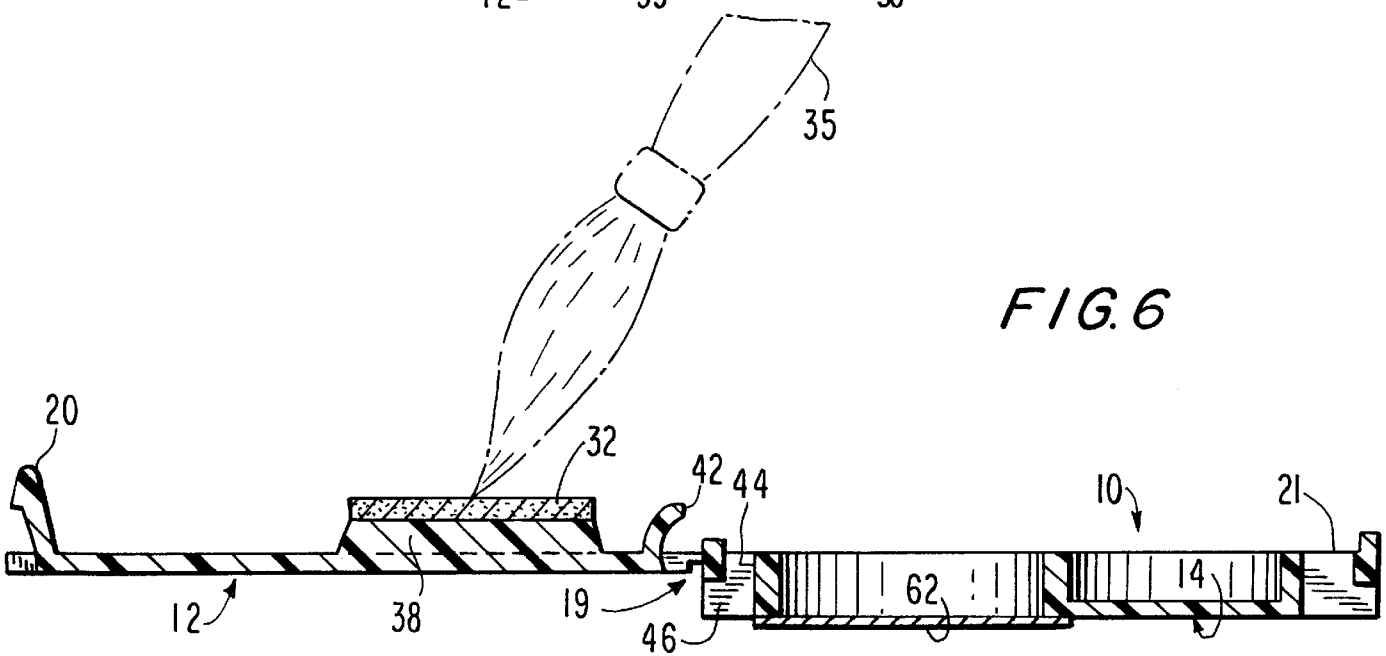
FIG. 6 is a sectional view of the container depicted in FIG. 5 in an open position as it is used.

Additionally, as best shown in FIG. 2, interior surface 26 of base 14 may include one or more recessed compartments or wells such as well 34 for housing additional items such as, for example, a product applicator or brush 35 shown in FIGS. 4 and 6. Although opening 30 and well 34 shown in FIG. 1 each have a preferred elongated oval shape extending transversely across base 14, it should be understood that the opening and the well are not limited to this particular shape.

Cover 12 has an interior surface 36 and an exterior or top surface 37. As best shown in FIG. 2, a preferred raised area 38 having a surface 39 and defining perimeter walls 40 extends from interior surface 36. Raised area 38 has a size and shape that sufficiently corresponds to the size and shape of opening 30 to enable the raised area to engage the opening. Desirably, when cover 12 is closed against base 14, raised area 38 extends a sufficient distance into opening 30 such that perimeter walls 40 of area 38 abut against perimeter walls 31 of the opening to form a seal at the opening.

Although it is preferred to utilize raised area 38 to sealingly engage opening 30, it should be understood, however, that other suitable sealing mechanisms, such as, for example, valve or gasket type seals, may be employed to seal interior surface 36 of cover 12 with respect to opening 30.

As indicated above, cover 12 and base 14 are pivotably connected at their respective rear edges 16 and 18 by a hinge mechanism. When closed, cover 12 and base 14 are compressively loaded by virtue of the construction of the hinge, the cover and base construction, and the latch. It should be understood that the compressive force results from the height of the hinge being less than the overall height of container 10. More particularly, when cover 12 is closed against base 14 and latched thereto, a compressive force is created as a result of the hinge being pulled to accommodate the height difference.

Figure 7:
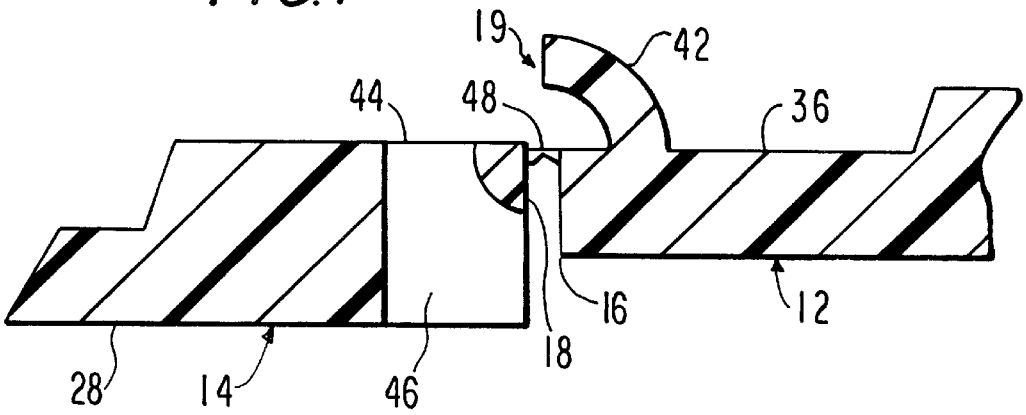
FIG. 7 is a partial sectional view of a preferred hinge construction of the container according to the present invention, the container shown in an open position.
Figure 8:
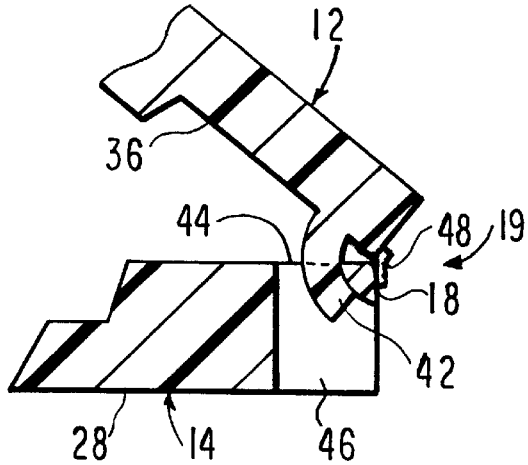
FIG. 8 is a view similar to FIG. 7 demonstrating the preferred hinge construction depicted in FIG. 7 as the container is being closed.
Figure 9:
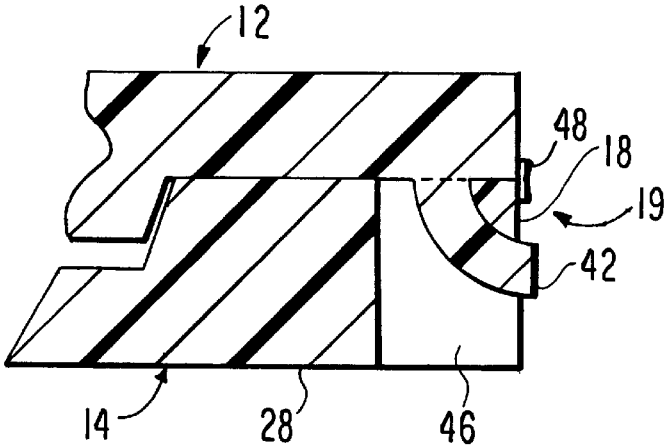
FIG. 9 is a view similar to FIGS. 7 and 8 demonstrating the preferred hinge construction depicted in FIGS. 7 and 8 when the container is closed.

Referring now to FIGS. 7, 8, and 9, a preferred hinge mechanism 19 includes one or more spaced apart curved protrusions 42 extending from interior surface 36 of cover 12 proximate to rear edge 16 of the cover. Curved protrusions 42 engage corresponding spaced apart transverse slots 44 in base 14 proximate to rear edge 18. Slots 44, also depicted in FIG. 1, extend completely through base 14 and open into corresponding spaced apart cavities or undercuts 46 formed in bottom surface 28. As cover 12 is articulated against base 14 in the operation of closing container 10 (FIGS. 7 and 8), protrusions 42 engage slots 44 and curve about rear edge 18 of the base (FIG. 8) to lock under and against the rear edge (FIG. 9). The combined effect of this preferred hinge arrangement and the height difference between the hinge and the overall height of the container is to compressively load the cover and base when the cover is latched closed.

Although not depicted in the drawings, it should be understood that protrusions 42 and corresponding slots 44 may be positioned outside of the side walls of the cover and base on extensions of respective rear edges 16 and 18 which extend laterally beyond the side walls of the cover and base.

While not required, it is desirable to provide a living hinge 48 to connect cover 12 and base 14 in the regions between adjacent slots 44, as best shown in FIG. 7. Also, it should be understood that a conventional pin hinge or other suitable hinge may be employed in lieu of living hinge 48. In the absence of living hinge 48 or other suitable hinge, compression is produced by protrusions 42 engaging corresponding slots 44 and base undercuts 46.

Figure 10:
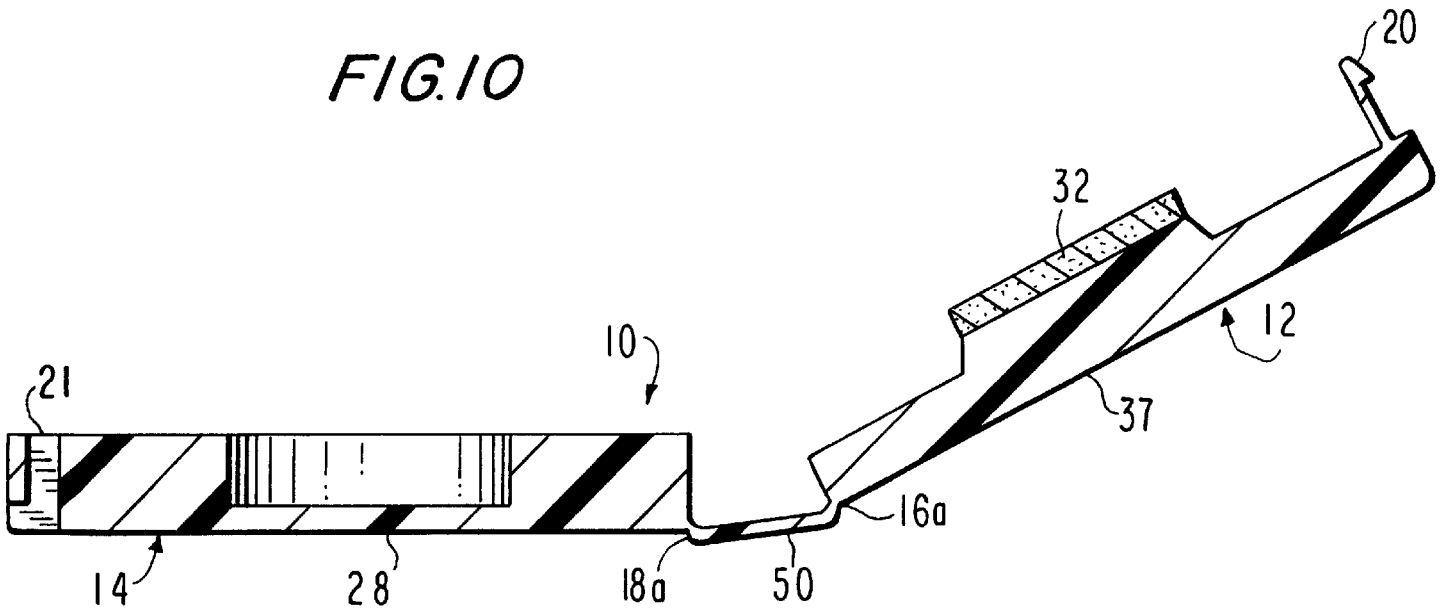
FIG. 10 is sectional view of an alternative embodiment of the container according to the present invention employing a flexible hinge connector, the container shown in an open position.

In an alternative embodiment depicted in FIGS. 10 and 11, the hinge mechanism may take the form of a substantially planar flexible connector 50 joining rear edge 16*a* of top surface 37 of cover 12 to rear edge 18*a* of bottom surface 28 of base 14. The flexible connector may extend along a portion of or substantially the entire length of container 10. A compressive force closing cover 12 against base 14 (FIG. 11) results from the height of connector 50 being less than the overall height of container 10.

Figure 12:
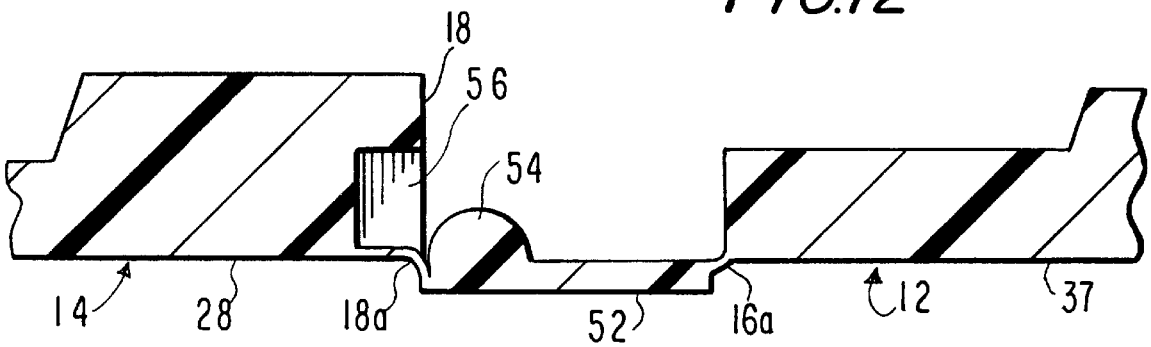
FIG. 12 is a partial sectional view of an alternative hinge construction of another embodiment of the container according to the present invention, the container shown in an open position.
Figure 13:
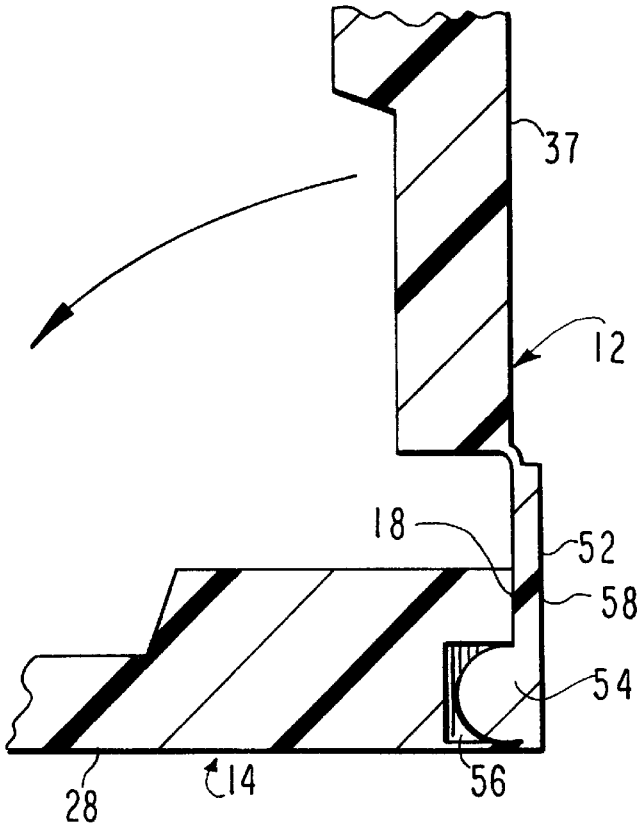
FIG. 13 is a view similar to FIG. 12 demonstrating the alternative hinge construction depicted in FIG. 12 as the container is being closed.
Figure 14:
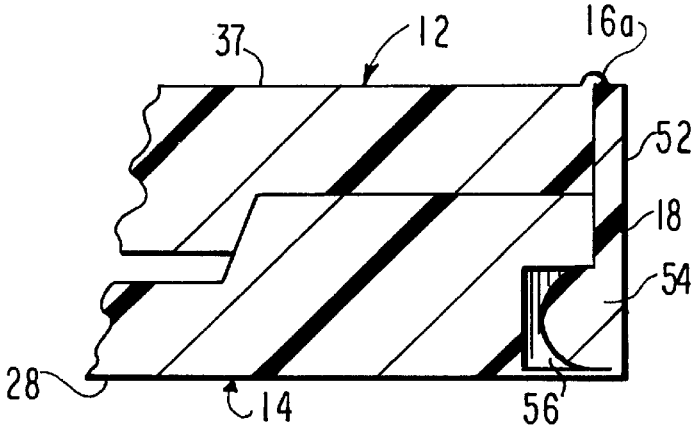
FIG. 14 is a view similar to FIGS. 12 and 13 demonstrating the alternative hinge construction depicted in FIGS. 12 and 13 when the container is closed.

FIGS. 12, 13, and 14 depict another embodiment of a hinge mechanism employing an alternative flexible connector 52. Flexible connector 52 joins rear edge 16*a* of top surface 37 of cover 12 to rear edge 18*a* of bottom surface 28 of base 14. Flexible connector 52 includes one or more spaced apart, preferably hemispherical, projections 54 extending therefrom in registration with corresponding receiving slots or undercuts 56 defined in bottom surface 28 of base 14. Projections 54 engage undercuts 56 when cover 12 is closed against base 14.

With reference to FIGS. 12, 13, and 14, as cover 12 is pivoted against base 14 in the operation of closing container 10 (FIGS. 12 and 13), projections 54 engage undercuts 56, and a medial region 58 of connector 52 abuts against rear edge 18 of the base (FIG. 13). Cover 12 pivots about rear edge 16*a* to abut against flexible connector 52 (FIG. 14). The combined effect of this hinge arrangement and the height difference between the height of the flexible connector and the overall height of the container is to compressively load the cover and base when the cover is latched closed.

Although not indicated in the drawings, it should be appreciated that the foregoing hinged container constructions according to the present invention may have application with respect to containers other than cosmetic containers in which the mechanisms for closing the container constitute the entire container. For example, the hinged constructions according to the present invention may be employed on the neck of a larger separate container such as a shampoo bottle or the like.

Figure 5:
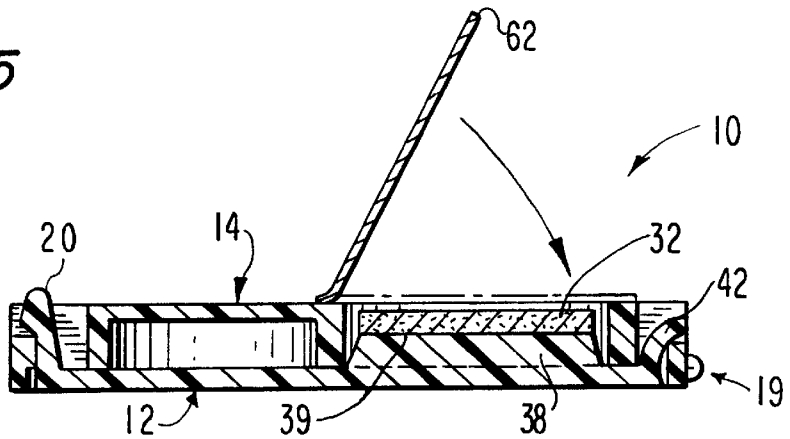
FIG. 5 is a sectional view of the container according to the present invention illustrating an alternative method of filling the container with product.

FIGS. 3 and 5 illustrate the operation of filling container 10 with a preselected amount of product, such as cosmetic product 32. As shown in FIG. 3, the filling of container 10 with product 32 is preferably accomplished by first applying the product to a surface 60 of a separate seal 62 such as an adhesive label or plastic sheet. Seal 62 is then adhered or otherwise affixed to bottom surface 28 of base 14 of closed container 10 such that the seal completely covers opening 30 and the product is introduced into and sealed in the opening in the space between the seal and surface 39 of raised area 38 of cover 12.

It should be understood that a substantially airtight seal is effected in container 10 by virtue of the construction and arrangement of cover 12 and base 14 as discussed in detail above, and the sealing of opening 30.

Alternatively, as depicted in FIG. 5, the filling of container 10 with a preselected amount of product 32 may be accomplished by first applying the product through opening 30 in bottom surface 28 of base 14 of the closed container directly onto surface 39 of raised area 38 which is exposed through the opening. Opening 30 is then covered with separate seal 62 to hold the product in the space between seal 62 and surface 39 of raised area 38. The sealing of opening 30 in conjunction with the construction and arrangement of cover 12 and base 14 as discussed above achieves a substantially airtight seal in container 10.

It should be appreciated that base 14 can be provided with more than one opening to accommodate a plurality of product samples in a single container 10.

Opening cover 12 of container 10 exposes product 32 for use. As shown in FIGS. 4 and 6, the surface onto which product 32 was applied during filling of container 10 is the surface from which the product may be withdrawn for use.

As discussed above, a preferred method of filling container 10 with a preselected amount of product 32 involves applying the product to surface 60 of seal 62 and then adhering the seal to bottom surface 28 of base 14 of closed container 10 such that the seal covers opening 30 and the product is sealed in the opening in the space between the seal and surface 39 of raised area 38 of cover 12. As illustrated in FIG. 4, as a result of this operation, product 32 resides on surface 60 of seal 62 in opening 30 and may be withdrawn therefrom (e.g., by brush 35) when cover 12 is opened to expose the product.

An alternative method of filling container 10 with product 32 as discussed above involves applying the product through opening 30 in bottom surface 28 of base 14 of the closed container directly onto surface 39 of raised area 38 (which is exposed through the opening) and then covering the opening with seal 62 to seal the product in the space between the seal and the surface of the raised area. As illustrated in FIG. 6, as a result of this operation, product 32 resides on surface 39 of raised area 38 and may be withdrawn therefrom (e.g., by brush 35) when cover 12 is opened to expose the product.

In summary, it should be appreciated that the various embodiments of the present invention provide a substantially airtight product container having a novel construction that may be filled with product in an easy and efficient fashion.

It will thus be seen that the objects set forth above, among those made apparent from the preceding description, are efficiently attained and, since certain changes may be made in the above constructions without departing from the spirit and scope of the invention, it is intended that all matter contained in the above description and depicted in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A container for holding a product, comprising:

a cover hingeably coupled to a base, said cover and said base each having interior and exterior surfaces and front and rear edges, at least one slot defined through said interior and exterior surfaces of said base proximate said rear edge of said base, at least one cavity formed in said exterior surface of said base beneath said at least one slot, at least one curved protrusion extending from said interior surface of said cover proximate said rear edge of said cover, said protrusion adapted to register with said at least one slot and engage said at least one slot and said rear edge of said base in said cavity when said cover is articulated against said base to hingeably close said container.

2. The container as claimed in claim 1, further comprising a living hinge to couple said cover to said base.

3. The container as claimed in claim 1, further comprising a pin hinge to couple said cover to said base.

4. The container as claimed in claim 1, further comprising at least one opening through said interior and exterior surfaces of said base, a raised area extending from said interior surface of said cover, said raised area adapted to sealingly engage said at least one opening in said base when said cover is pivoted to said closed position with respect to said base, and a seal to cover said at least one opening at said exterior surface of said base to hold a product within said at least one opening between said raised area and said seal.

5. The container as claimed in claim 1, further comprising a closure at said front edges of said base and said cover to releasably secure said cover in a closed position against said base.

6. The container as claimed in claim 1, further comprising:

at least one opening through said interior and exterior surfaces of said base arranged and constructed to permit a product to be introduced into said container through said base when said cover is in said closed position against said base, and a seal to cover said at least one opening at said exterior surface of said base to hold said product within said at least one opening between said interior surface of said cover and said seal.

7. The container as claimed in claim 6, wherein said product is a preselected amount of cosmetic product.

8. The container as claimed in claim 6, further comprising a recessed well defined in said interior surface of said base to hold an item.

9. The container as claimed in claim 8, wherein said item is a brush.

10. The container as claimed in claim 1, wherein said cover is coupled to said base by a hinge that has a height that is less than an overall height of said container when said cover is closed against said base.

11. A container for holding a product, comprising:

a cover hingeably coupled to a base, said cover and said base each having interior and exterior surfaces and front and rear edges, at least one slot defined in said exterior surface of said base at said rear edge of said base, a substantially planar flexible member coupling said rear edge of said cover and said rear edge of said base, at least one protrusion extending from said flexible member, said protrusion adapted to register with said at least one slot and engage said slot when said cover is articulated against said base to hingeably close said container.

12. The container as claimed in claim 11, further comprising at least one opening through said interior and exterior surfaces of said base, a raised area extending from said interior surface of said cover, said raised area adapted to sealingly engage said at least one opening in said base when said cover is pivoted to said closed position with respect to said base, and a seal to cover said at least one opening at said exterior surface of said base to hold a product within said at least one opening between said raised area and said seal.

13. The container as claimed in claim 11, further comprising a closure at said front edges of said base and said cover to releasably secure said cover in a closed position against said base.

14. The container as claimed in claim 11, wherein said protrusion has a hemispherical shape.

15. The container as claimed in claim 11, further comprising:

at least one opening through said interior and exterior surfaces of said base arranged and constructed to permit a product to be introduced into said container through said base when said cover is in said closed position against said base, and a seal to cover said at least one opening at said exterior surface of said base to hold said product within said at least one opening between said interior surface of said cover and said seal.

16. The container as claimed in claim 15, wherein said product is a preselected amount of cosmetic product.

17. The container as claimed in claim 15, further comprising a recessed well defined in said interior surface of said base to hold an item.

18. The container as claimed in claim 17, wherein said item is a brush.

19. A method for filling an airtight container for holding a product, said container having a cover hingeably coupled to a base; said cover and said base having respective interior and exterior surfaces, at least one opening through said interior and exterior surfaces of said base, said interior surface of said cover adapted to sealingly engage said at least one opening in said base when said cover is hingeably closed against said base, said method comprising the steps of:

(a) applying a product to a surface of a separate seal; and (b) covering said at least one opening at said exterior surface of said base with said seal such that said product is introduced into said at least one opening and is held therewithin between said interior surface of said cover and said seal.

20. A method for filling an airtight container for holding a product, said container having a cover hingeably coupled to a base; said cover and said base having respective interior and exterior surfaces, at least one opening through said interior and exterior surfaces of said base, said interior surface of said cover adapted to sealingly engage said at least one opening in said base when said cover is hingeably closed against said base, said method comprising the steps of:

(a) applying a product to said interior surface of said cover through said at least one opening when said cover is closed against said base; and (b) covering said at least one opening at said exterior surface of said base with a separate seal such that said product is sealed therewithin between said interior surface of said cover and said seal.

21. The method as claimed in claim 20, wherein said interior surface of said cover includes a raised area extending therefrom to sealingly engage said at least one opening in said base when said cover is hingeably closed against said base, said raised area having a surface, and wherein said product is applied to said surface of said raised area such that said product is sealed between said surface of said raised area and said seal.

* * * * *